US008845823B2

(12) United States Patent
Christiansen et al.

(10) Patent No.: US 8,845,823 B2
(45) Date of Patent: Sep. 30, 2014

(54) METHOD OF ACTIVATING AN ARTICLE OF PASSIVE FERROUS OR NON-FERROUS METAL PRIOR TO CARBURISING, NITRIDING AND /OR NITROCARBURISING

(75) Inventors: Thomas Lundin Christiansen, Frederikssund (DK); Thomas Strabo Hummelshøj, Frederiksberg (DK); Marcel A. J. Somers, Billund (DK)

(73) Assignees: Expanite A/S, Kongens Lyngby (DK); Danmarks Tekniske Universitet—DTV, Kongens Lyngby (DK)

( * ) Notice: Subject to any disclaimer, the term of this patent is extended or adjusted under 35 U.S.C. 154(b) by 347 days.

(21) Appl. No.: 13/384,689

(22) PCT Filed: Jul. 19, 2010

(86) PCT No.: PCT/DK2010/050194

§ 371 (c)(1),
(2), (4) Date: Jan. 18, 2012

(87) PCT Pub. No.: WO2011/009463

PCT Pub. Date: Jan. 27, 2011

(65) Prior Publication Data

US 2012/0111456 A1 May 10, 2012

Related U.S. Application Data

(60) Provisional application No. 61/213,824, filed on Jul. 20, 2009.

(30) Foreign Application Priority Data

Jul. 20, 2009 (EP) ..... 09165902

(51) Int. Cl.

| | |
|---|---|
| ***C23C 8/28*** | (2006.01) |
| ***C23C 8/24*** | (2006.01) |
| ***C23C 8/26*** | (2006.01) |
| ***C23C 8/20*** | (2006.01) |
| ***C23C 8/22*** | (2006.01) |

(52) U.S. Cl.
USPC ..... 148/218; 148/230; 148/225; 148/238; 148/206; 148/231

(58) Field of Classification Search
USPC ..... 148/218, 230, 225, 238, 206, 231
See application file for complete search history.

(56) References Cited

U.S. PATENT DOCUMENTS 1,772,866 A 8/1930 Hirsch

FOREIGN PATENT DOCUMENTS

| | | | |
|---|---|---|---|
| EP | 0 588 458 | A1 | 3/1994 |
| EP | 1 521 861 | B1 | 4/2005 |
| EP | 1 707 646 | A1 | 10/2006 |
| EP | 1 712 658 | A1 | 10/2006 |
| FR | 2 483 962 | A1 | 12/1981 |
| GB | 610 953 | A | 10/1948 |
| JP | 2004-91892 | A | 3/2004 |
| JP | 2005-232518 | A | 9/2005 |
| WO | 2006/136166 | A1 | 12/2006 |

OTHER PUBLICATIONS

Notice to Grant issued in European Patent Application No. 10734902.9 dated May 30, 2012, 3 pages.
Written Opinion issued in International Patent Application No. PCT/DK2010/050194, 8 pages.
International Preliminary Report on Patentability issued in International Patent Application No. PCT/DK2010/050194, 10 pages.
Chen, K. C. et al., "The urea nitrocarburizing of cast irons with various graphite morphologies", Journal of Materials Science, 24, pp. 2833-2838, (1989).
Hertz, D., et al., "Technologies for low temperature carburising and nitriding of austenitic stainless steel", International Heat Treatement and Surface Engineering, vol. 2, No. 1, pp. 32-38, (2008) XP-002557434.
Stock, H.-R, et al., "Plasma-assisted chemical vapour deposition with titanium amides as precursors", Surface and Coatings Technology, vol. 46, pp. 15-23, (1991).
Dunn, R. P., et al., "Urea Process for Nitriding Steels", Transactions of the A.S.M. pp. 776-791, (1942).
Schaber, P.M. et al. "Thermal decomposition (pyrolysis) of urea in an open reaction vessel" Thermochimica Acta vol. 424, pp. 131-142, (2004).
Cataldo, F. et al., "TGA-FT-IR study of pyrolysis of poly(hydrogen cyanide) synthesized from thermal decomposition of formamide, Implications in cometary emissions", Journal of Analytical and Applied Pyrolysis, vol . 87, pp. 34-44, (2010).

*Primary Examiner* — Jessee Roe
(74) *Attorney, Agent, or Firm* — Nath Goldberg & Meyer; Joshua B. Goldberg

(57) ABSTRACT

A method of activating an article of passive ferrous or non-ferrous metal by heating at least one compound containing nitrogen and carbon, wherein the article is treated with gaseous species derived from the compound. The activated article can be subsequently carburized, nitrided or nitrocarburized in shorter time at lower temperature and resulting superior mechanical properties compared with non-activated articles and even articles of stainless steel, nickel alloy, cobalt alloy or titanium based material can be carburized, nitrided or nitrocarburized.

20 Claims, 5 Drawing Sheets

METHOD OF ACTIVATING AN ARTICLE OF PASSIVE FERROUS OR NON-FERROUS METAL PRIOR TO CARBURISING, NITRIDING AND /OR NITROCARBURISING

This is a National Phase Application filed under 35 U.S.C. 371 as a national stage of PCT/DK2010/050194, filed 19 Jul. 2010, claiming the benefit from European Application No. 09165902.9, filed 20 Jul. 2009, and claiming the benefit under 35 USC 119(e) from U.S. Provisional Application No. 61/213,824, filed 20 Jul. 2009, the content of each of which is hereby incorporated by reference in its entirety.

TECHNICAL FIELD

The present invention relates to a method of activating an article of passive ferrous or non-ferrous metal. The present invention also relates to a method of carburising, nitriding or nitrocarburising an article which as has been activated in accordance with the present invention.

BACKGROUND ART

Thermo-chemical surface treatments of iron and steel by means of nitrogen or carbon carrying gases are well-known processes, called nitriding or carburising, respectively. Nitrocarburising is a process in which a gas carrying both carbon and nitrogen is used. These processes are traditionally applied to improve the hardness and wear resistance of iron and low alloyed steel articles. The steel article is exposed to a carbon and/or nitrogen carrying gas at an elevated temperature for a period of time, whereby the gas decomposes and carbon and/or nitrogen atoms diffuse through the steel surface into the steel material. The outermost material close to the surface is transformed into a layer with improved hardness, and the thickness of this layer depends on the treatment temperature, the treatment time and the composition of the gas mixture.

U.S. Pat. No. 1,772,866 (Hirsch) discloses a process for nitriding an article of iron or molybdenum steel in a crucible with urea. The article and urea are introduced together in the crucible and then heated to a temperature sufficiently to release nascent nitrogen from urea.

Dunn et al. "Urea Process for Nitriding Steels", Transactions of the A. S. M., page 776-791, September 1942, discloses a process for nitriding steels using urea. Urea was selected as a cheap material known to evolve ammonia upon heating and because it is easy to handle and store. In one arrangement solid urea is heated together with the steel article in a nitriding furnace. In another improved arrangement the urea was heated in an external generator and the evolved ammonia was supplied to a furnace containing the steel article.

Chen et al., Journal of Materials Science 24 (1989), 2833-2838, discloses nitrocarburising of cast irons by treatment with urea at 570° C. in 90 min. It is stated that urea dissociates at temperatures of between 500 and 600° C. into carbon monoxide nascent nitrogen and hydrogen.

Schaber et al., Thermochimica Acta 424 (2004) 131-142 (Elsevier) analysed the thermal decomposition of urea in an open vessel and found a number of different decomposition products including cyanic acid, cyanuric acid, ammelide, biuret, ammeline and melamine during the heating at temperatures from 133 to 350° C. Additionally, substantial amounts of $NH_3$ are formed by the different decomposition sub-reactions. Substantial sublimation and formation of further decomposition products occurs at temperatures above 250° C.

Accordingly, during the decomposition of urea, it is not completely known which intermediate products occur and how long time each of them occurs before a further decomposition takes place when urea is heated to temperatures up to 500° C.

Cataldo et al. [Journal of Analytical and Applied Pyrolysis 87 (2010) 34-44] analysed the thermal decomposition of formamide ($HCONH_2$). The reaction is rather complex and involves decomposition products as HCN, $NH_3$ and CO.

In nitriding and nitrocarburising praxis the activation of the surface prior to actual treatment is often established by an oxidation treatment at a temperature ranging from, typically, 350° C. to just below the nitriding/nitrocarburising temperature. For highly alloyed self-passivating materials the pre-oxidation temperature is very high and appreciably higher than the temperature at which nitriding/nitrocarburising can be carried out without avoiding the development of alloying element nitrides. Various alternatives for the activation of self-passivating stainless steel have been proposed.

EP 0588458 (Tahara, et al.) discloses a method of nitriding austenitic steel comprising heating austenitic stainless steel in a fluorine- or fluoride-containing gas atmosphere for activation followed by heating the fluorinated austenitic stainless steel in a nitriding atmosphere at a temperature below 450° C. to form a nitrided layer in the surface layer of the austenitic stainless steel. In this two stage process the passive layer of the stainless steel surface is transformed into a fluorine-containing surface layer, which is permeable for nitrogen atoms in the subsequent nitriding stage. The fluorine- or fluoride-containing gas atmosphere itself does not provide nitriding of the stainless steel article. Addition of halogen- or halide-containing gases for activation is a general method and is known to behave aggressively towards the process equipment interior and can lead to severe pitting of the furnace, fixtures and armatures.

EP 1521861 (Somers, et al.) discloses a method of case-hardening a stainless steel article by means of gas including carbon and/or nitrogen, whereby carbon and/or nitro-gen atoms diffuse through the surface of the article, the case-hardening is carried out below a temperature at which carbides and/or nitrides are produced. The method includes activating the surface of the article, applying a top layer on the activated surface to prevent repassivation. The top layer includes metal which is catalytic to the de-composition of the gas.

WO2006136166 (Somers & Christiansen) discloses a method for low temperature carburising of an alloy with a chromium content of more than 10 wt. % in an atmosphere of unsaturated hydrocarbon gas. The unsaturated hydrocarbon gas effectively activates the surface by removal of the oxide layer and acts as a source of carbon for subsequent or simultaneous carburising. In the listed examples acetylene is used and the du-ration of the carburising treatment ranges from 14 hours to 72 hours. An inherent downside by applying unsaturated hydrocarbon gas as a carburising medium and as activator is the strong tendency for sooting, which effectively slows down the carburising process and prevents control of the carbon content in the steel. In order to sup-press the tendency for sooting the temperature has to be lowered, which results in even longer treatment times (cf. above).

EP1707646B1 discloses a method for activation of metal surface prior to nitriding or carburising. A carbon containing gas such as CO or acetylene and a nitrogen containing gas such as $NH_3$ are introduced into a furnace and heated to at least 300° C. By reaction with a metallic catalyst HCN is formed. For sufficiently high concentrations of HCN (100 mg/m3) the passive surface of the metallic member is activated. The examples shown describe activation of stainless steel; the diffusion treatment is carried out at a temperature of 550° C., which results in the precipitation of nitrides or carbides. The temperature for the activation is stated to be above 300° C. for a sufficient reaction rate between the carbon bearing compound and $NH_3$. This method therefore requires comparatively high temperatures needed for reacting the two gases.

JP2005232518A discloses a surface hardening treatment method in which a gaseous mixture comprising a carbon feeding compound and a nitrogen feeding compound, the mixture being gaseous at 150° C., is heated to above 200° C. A catalyst installed in the furnace converts the gaseous mixture to HCN which then acts on the surface of a metallic article to modify and activate a passivated film on the surface. Successively, gas nitriding and/or gas nitriding-carburising is performed at 400 to 600° C. This method requires the provision of two separate feed components which are both gaseous, which requires potentially complex installations such as separate gas lines, valves and a gas mixer. Furthermore, this method relies on the presence of a suitable catalyst for converting the gaseous mixture to HCN. In case of the articles being employed as catalyst the resulting gas composition and HCN level is highly dependent on the surface area and composition of the treated articles in the furnace. This is undesirable in terms of reproducibility and controllability.

GB610953 relates to a process by which nitride cases may be formed on austenitic and stainless steels without the need of a preliminary depassivation (i.e. activation) treatment. The method requires the presence during nitriding of a compound of an alkali or alkaline earth metal with nitrogen or with nitrogen and hydrogen in an atmosphere of a gaseous nitrogen-liberating material, such as ammonia. The alkali or alkaline earth metal compound may be an amide such as sodium amide ($NaNH_2$) or calcium amide ($Ca(NH_2)_2$). The alkali or alkaline earth metal compounds are simply heated together with the steel article to a nitriding temperature of 475-600° C. Thus, the compounds are used for forming a case of nitrides in stainless steel. The formation of nitrides is associated with a loss of corrosion resistance.

Hertz et al. ("Technologies for low temperature carburising and nitriding of austenitic stainless steel" INTERNATIONAL HEAT TREATMENT AND SURFACE ENGINEERING, vol. 2, no. 1, 3 Mar. 2008, pages 32-38) discuss carburising and nitriding treatments at low temperatures (350-450° C.), acknowledging the diffusion barrier of oxide layers. The preferred method for activating the article to overcome this diffusion barrier is fluoridation with $NF_3$.

Stock et al. ("Plasma-assisted chemical vapour deposition with titanium amides as precursors" SURFACE AND COATINGS TECHNOLOGY, ELSEVIER, AMSTERDAM, NL, vol. 46, no. 1, 30 May 1991, pages 15-23) relates to the production of wear-resistant coatings such as TiN in low-temperature plasma-assisted chemical vapour deposition. In this regard, it is suggested to use titanium amide ($Ti(N(CH_3)_3)_4$) together with steel substrates at 200-500° C. to establish such a coating. Stock et al. are silent on any preceding steps for activating the steel surface. Stock et al. exclusively relate to the production of a coating, but are silent on case hardening, i.e. the modification of an existing surface through diffusion treatment.

In view of the mentioned prior art methods, there is still a need for an activation method for a passivated article prior to carburising, nitriding or nitrocarburising, said activation method being simple, energy-efficient and safe.

It is therefore a first object of the present invention to provide a simple and energy-efficient method of activating an article of passive ferrous or non-ferrous metal.

It is a second object of the present invention to provide a safe method of activating an article of passive ferrous or non-ferrous metal, said method minimising health risks.

It is a third object of the present invention to provide a method of activating an article of passive ferrous or non-ferrous metal, which method leads to an improved activation prior to subsequent carburising, nitriding or nitrocarburising.

It is a fourth object of the present invention to provide a method of activating an article of passive ferrous or non-ferrous metal, which method is conveniently coupled with subsequent carburising, nitriding or nitrocarburising.

SUMMARY OF THE INVENTION

The new and unique way in which one or more of the above-mentioned objects are addressed is a method of activating an article of passive ferrous or non-ferrous metal, which activation comprises heating the article to a first temperature, heating at least one compound containing nitrogen and carbon, hereinafter called N/C-compound, to a second temperature for providing one or more gaseous species, and contacting the article with the gaseous species, wherein the N/C-compound comprises at least four atoms.

In another aspect, the present invention relates to a method of carburising, nitriding or nitrocarburising an article of ferrous or non-ferrous metal, wherein the article is activated by the method according to the present invention prior to carburising, nitriding or nitrocarburising.

Definitions

As used herein, the term "activating" refers to the complete or partial removal of a diffusion barrier on a surface of an article of passive ferrous or non-ferrous material. Typically, the diffusion barrier will comprise one or more oxide layers which act as a hindrance to the establishment of a diffusion layer thereby impairing the penetration and diffusion of nitrogen and/or carbon into the article surface during case hardening by carburising, nitriding or nitrocarburising.

As used herein, the term "N/C-compound" refers to a chemical substance, i.e. a molecule, containing at least one carbon atom and at least one nitrogen atom.

As used herein, the term "gaseous species" refers to gas molecules, i.e. one or more chemical substances existing in the gas phase as distinct from the solid phase or the liquid phase.

Amides are derivatives of oxoacids in which an acidic hydroxy group has been replaced by an amino or substituted amino group.

DETAILED DESCRIPTION OF THE INVENTION

In a first aspect, the present invention relates to a method of activating an article of passive ferrous or non-ferrous metal, which activation comprises heating the article to a first temperature, heating at least one compound containing nitrogen and carbon, hereinafter called N/C-compound, to a second temperature for providing one or more gaseous species, and contacting the article with the gaseous species, wherein the N/C-compound comprises at least four atoms. Preferably, the inventive method is used to activate an article prior to subsequent case hardening by carburising, nitriding or nitrocarburising. Generally, the N/C-compounds used in the activation method of the present invention may be selected among compounds having a single, double or triple carbon-nitrogen bond. Preferably, the N/C-compound is a liquid or a solid at room temperature (25° C.) and atmospheric pressure (1 bar). This facilitates the handling of the N/C-compound and its possible introduction into a heating apparatus used in the method of the present invention. Since the N/C-compound of the present invention has at least four atoms, highly toxic compounds such as HCN are excluded. During heating of the N/C-compound, HCN may evolve as decomposition product of the N/C-compound, however, this will usually occur in a confined space such as a furnace, which renders the inventive method safer than known activation methods since external handling of HCN is no longer necessary.

The gaseous species evolving from the N/C-compound upon heating may be decompositions products of the same, or the N/C-compound as such in gaseous form. The gaseous species are transported to the article, usually by diffusive and/or convective gas transport, and are contacted with the same. Preferably, the first and the second temperatures are below 500° C. In this way formation of nitrides or carbides can be prevented. This is particularly relevant for stainless steel and similar alloys where the corrosion resistance may be lost if nitrides or carbides are formed. The first and the second temperature may be the same.

The article may be made of stainless steel, a nickel alloy, a cobalt alloy, a titanium based material or combinations thereof. Such materials are impossible or difficult to carburise, nitride or nitrocarburise using prior art techniques. It was found that the activation method of the present invention can be used for the treatment of passivated and self-passivating metals, such as stainless steel and titanium-based materials. Passivated materials are materials (unintentionally) passivated as a consequence of a prior manufacturing process. Self-passivating materials are materials that passivate themselves generally by the formation of an oxide layer on the surface, which effectively hinders the incorporation of N and C into the article. It is believed that the passivating feature(s) or oxide layer is/are effectively removed or transformed during contacting with the gaseous species derived from the N/C-compound in the inventive method. Thus once the passivating feature(s) or oxide layer is/are removed the incorporation of nitrogen and carbon into the material as is necessary for case hardening by nitriding/carburising/nitrocarburising is possible.

According to a preferred embodiment, the first temperature is higher than the second temperature. In particular when urea is used as N/C-compound it has been surprisingly found that activation is greatly improved if the N/C-compound is heated to a second temperature (preferably <250° C.) which is lower than the first temperature of the heated article. Without wishing to be bound by theory, it is believed that the lower second temperature contributes to a longer life time of the gaseous species derived from heating the N/C-compound. The gaseous species derived from the N/C compounds, which are typically decomposition products thereof, activate the article prior to the actual surface hardening treatment. The difference between the first temperature and the second temperature is preferably at least 50° C., more preferably at least 100° C.

According to another embodiment of the present invention, the article and the N/C-compound are heated in a heating apparatus. The heating apparatus may be a crucible, a furnace or the like.

According to another embodiment of the present invention, the heating apparatus has a first heating zone and a second heating zone, wherein the article is heated to the first temperature in the first heating zone and the N/C-compound is heated to the second temperature in the second heating zone, wherein the first temperature is higher than the second temperature. In particular when using urea as the N/C-compound, this has been surprisingly found to result in a greatly improved activation of the article as compared to situations in which the N/C-compound and the article are heated to the same temperature.

According to another embodiment of the present invention, the heating apparatus has a gas inlet and a gas outlet for providing a passage of gas through the heating apparatus. Ideally, the article is placed downstream of the N/C-compound. In this way, the gaseous species derived from the N/C-compound are transport to the article for contacting the same. The passage of gas may be established by using a suitable carrier gas that does not oxidise the article, such as hydrogen, argon and nitrogen. A usable carrier gas may be any gas which behaves non-oxidative to the article to be treated. The N/C-compounds may be introduced into the heating apparatus by means of the carrier gas. Also, the gaseous species derived from the N/C-compounds may be distributed throughout the heating apparatus by the passage of gas. This is believed to lead to a better distribution of the gaseous species throughout the furnace and to improve the uniformity of the treatment.

According to another embodiment of the present invention, the article is heated to the first temperature before the N/C-compound is introduced into the heating apparatus. The N/C-compound may be fed continuously or discontinuously into the furnace as a liquid spray or as solid particles using a carrier gas. The article is placed, for example, in a furnace maintained at a temperature of 400-500° C. Subsequently, one or more N/C-compounds in gaseous, liquid or solid state are introduced into the furnace. This leads to a rapid, almost instantaneous, heating of the N/C-compound which has been found to result in improved activation. Without wishing to be bound by theory, it is believed that rapid, close to instantaneous, heating of the N/C-compound may lead to a beneficial composition of gaseous species derived from the N/C-compound. Typically, the derived gaseous species are expected to have short life times at the temperatures employed for heating the article. Therefore, in embodiments where the first and the second temperature are the same, i.e. where there is no difference between the temperature to which the article is heated and the temperature to which the N/C-compound is heated, it is preferred to heat the N/C-compound as rapidly as possible.

The rate of the formation of the gaseous species derived from the N/C-compound depends on the temperature, but may also be modified by use of a carrier gas in the heating apparatus and in a spray of the N/C-compound introduced continuously or discontinuously into the heating apparatus.

According to a preferred embodiment of the present invention, the N/C-compound is an amide. The amide is preferably metal-free.

According to a more preferred embodiment of the present invention, the N/C-compound is selected from urea, acetamide and formamide.

According to particularly preferred embodiment of the present invention, the N/C-compound is urea. Based on the experiments carried out with urea it was found that particularly active gaseous species are formed when urea is used as N/C-compound, particularly when heated to a temperature of 135-250° C.

The present invention is based on experiments carried out at conditions by which a passivated article is exposed to gaseous species derived from a heated N/C-compound such as urea, which urea is partially decomposed due to heating. It is believed that the passivated surface of the article is depassivated by one or more of these gaseous decomposition products. It is hypothesised that the active compounds are free radicals and/or compounds containing both C and N, e.g. HNCO and HCN.

According to another embodiment of the present invention, the first temperature is below 500° C. When the contacting of the article with the gaseous species is carried out at or below 500° C. it is believed that the reaction rates involved during the decomposition of the N/C compound are sufficiently decreased to postpone the final formation of the lesser reactive end-decomposition products.

According to another embodiment of the present invention, the first temperature is 250-300° C. In particular when using urea as the N/C-compound, this has been found to be the temperature range yielding the best activation results.

According to another embodiment of the present invention, the second temperature is below 250° C. In particular when using urea as N/C-compound, this comparatively low temperature regime was surprisingly found to yield the best activation results. It is assumed that this relates to the nature and composition of the resulting gaseous species. Preferably, the temperature to which the N/C-compound is heated is kept below 250° C., more preferably below 200° C., most preferably at 135-170° C.

According to another embodiment of the present invention, the article is contacted with the gaseous species for at least one hour. It is important that the passivated surfaces are treated with such active compounds for a sufficient period of time before they are exposed to a carburising, nitriding or nitrocarburising environment, preferably for at least one hour.

It is suggested that the inventive activation method could also be used as an activation treatment for other surface treatments, including thermochemical treatment other than carburising, nitriding and nitrocarburising, as well as coating by for example chemical vapour deposition and physical vapour deposition. Furthermore, the inventive method could be the first stage in a series of treatments, combining carburising, nitriding or nitrocarburising with subsequent coating or conversion of the hard zone or compound layer obtained by carburising, nitriding or nitrocarburising.

In another aspect, the present invention relates to a method of carburising, nitriding or nitrocarburising an article of ferrous or non-ferrous metal, characterised in that the article is activated by the method according to the present invention prior to carburising, nitriding or nitrocarburising. A major advantage of the present invention is the finding that, due to the inventive activation method, subsequent carburising, nitriding or nitrocarburising can be carried out at a temperature, at which alloying elements do not form nitrides or carbides during the treatment. This means that the inventive method also can be used for the treatment of articles of stainless steels, nickel super-alloys and cobalt alloys and other articles containing a relatively high amount of alloying components. If these articles are treated at elevated temperature for prolonged time the alloying components have a tendency to form compounds as nitrides and carbides with the consequence that the alloying component is withdrawn from solid solution in the article whereby an inherent property of the solid solution, such as corrosion resistance, is lost.

A further important feature of the present method is that it enables a subsequent treatment where a layer or a zone grows into the existing material. In the case where no compound layer is formed in the subsequent carburising, nitriding or nitrocarburising treatment N and/or C are dissolved into interstitial sites of the existing crystal lattice. This provides an excellent cohesion between the hard zone and the softer starting material. Also a gradual transition of the properties of the metal to the properties of the hardened zone is an important feature enabled by the inventive method, particularly if the inventive method is followed by nitrocarburising.

The best performance requires a gradual and not too steep transition building up a bearing strength supporting the very hard part. This is obtained with a carbon profile under nitrogen. The solubility of carbon is much lower than that of nitrogen and carbon will always be located deepest.

Based on experiments, it was found that a desirable gradual transition is obtainable by activating and subsequent nitrocarburising with urea or other N/C-compounds in accordance with the inventive method.

The inventive method is especially suitable for the nitriding or nitrocarburising of self-passivating metals which usually form an oxide skin or layer on the surface. Such oxide skin inhibits the dissolution of the material into surrounding liquids or gas. Thus, nitriding, and to a lesser extent nitrocarburising, of self-passivating metals was difficult or impossible by prior art methods based on treatment using the same compounds during activation and subsequent nitriding/nitrocarburising treatment.

The above situation for self-passivating metals may also be relevant in case of materials which have been passivated by a previous treatment as for example in case of a local passivation after cutting using a cutting lubricant and heavy surface deformation. This kind of passivation generated during the processing of the material is normally removed after the processing, but in some cases it will not be removed completely by the current cleaning methods. Carburising, nitriding and nitrocarburising of such materials which are locally passivated will not result in a uniform surface by the prior art methods using temperatures below 500° C. whereas the inventive method starting with a lower temperature will result in removal of any passivation layers and probably also dirt from the surfaces by the action of the starting N/C-compounds and their first decomposition intermediates. In this way the carburising/nitriding/nitrocarburising stage results in a more uniform surface treatment without untreated regions.

According to another embodiment of the present invention, the carburising, nitriding or nitrocarburising and the preceding activation are carried out successively in a single heating apparatus, wherein carburising, nitriding or nitrocarburising is carried out by heating the article to a third temperature which is at least as high as the first temperature. Advantageously activation is performed during continuous heating towards the final carburising, nitriding of nitrocarburising temperature, i.e. the third temperature. Preferably, the third temperature is higher than the first and the second temperatures. Such subsequent carburising, nitriding or nitrocarburising is accelerated when the temperature is increased, because solid state diffusion of N/C, which plays a major role in the carburising, nitriding or nitrocarburising kinetics, is accelerated at increased temperature. Advantageously, after activation is complete, the temperature of the article is raised to the third temperature and nitriding/nitrocarburising/carburising takes place.

According to another embodiment of the present invention, the third temperature is below 500° C. The inventive activation method allows for such comparatively low temperatures during carburising, nitriding or nitrocarburising. This method results in shorter total treatment times compared with conventional nitriding and nitrocarburising methods of the prior art, together with excellent combinations of technical properties for the treated articles.

For the treatment of materials where the development of a compound layer, consisting of nitrides, carbides or carbonitrides, is desired, the end temperature may exceed 500° C. during the nitriding/nitrocarburising stage, provided that the material previously has been sufficiently depassivated in the first stage of activation at a lower temperature.

According to another embodiment of the present invention, the same N/C-compound is used both for activation and for subsequent carburising, nitriding or nitrocarburising. For example, urea can be placed in a heating apparatus together with the passivated article, whereupon urea is heated to 100-200° C. and the article is heated to 250-300° C. for activation of the article. After activation is completed the article may be heated to a temperature of 400-500° C. for case hardening using urea as nitrocarburising agent. In this case the actual compounds responsible for the nitriding or nitrocarburising are believed to be (partly) decomposed. In any case can the same starting material be used during the complete treatment including the activation and the subsequent nitriding or nitrocarburising. Hereby, a low-cost and simple operation of the complete treatment is contemplated since the same furnace, the same installations, and the same compound is used, and only the temperature is varied over time.

In one embodiment the article to be treated and solid urea powder are both placed at ambient temperature in a furnace and the furnace is heated continuously to an end temperature of between 400 and 500° C. while a carrier gas, for example, hydrogen gas, distributes the evolving gaseous species throughout the furnace. During the first part of the heating, the urea powder evaporates followed by a stepwise decomposition to gaseous intermediates activating (depassivating) the surface of the article. Thereafter, as the temperature increases, the gaseous intermediates are further decomposed to the decomposition products providing the final nitriding and/or nitrocarburising of the activated surfaces. Such further decomposition is accelerated when the temperature exceeds 500° C.

According to another embodiment the article to be treated is placed in the furnace and maintained at a temperature of between 350 and 500° C. and the C/N-compound, e.g. formamide, is introduced into the furnace by a carrier gas or by a doser. Formamide in the form of a liquid is fed into the furnace by an electronic doser or by a pressured feeder system. When the liquid enters the hot furnace it rapidly vaporizes and forms gaseous species which activate the article. After the article is activated, nitrocarburising can be performed in the same gas mixture or in a different gas mixture. It is believed that for the case of formamide the main active species for activation and nitrocarburising is HCN.

According to an alternative embodiment, subsequent case hardening by carburising, nitriding or nitrocarburising is not carried out with the N/C-compound used for activation of the article. Thus any nitrogen and/or carbon containing material known to be usable for carburising, nitriding or nitrocarburising can be used after the activation. Depending on the actual article to be treated and the desired end properties this embodiment can be more flexible.

Moreover, the present invention relates to an article of ferrous or non-ferrous metal obtainable by the method of carburising, nitriding or nitrocarburising according to the present invention. Important characteristics of the articles obtainable after the carburising, nitriding and/or nitrocarburising the articles, which have been activated by the inventive method are an increased hardness and especially the hardness profile. The chemical modification changes the mechanical properties locally and thus the entire performance of the material by its final application. The composition profile leads both to a hardness profile and to a profile of residual compressive stress. The hardness profile is decisive for the tribological properties (i.e. friction, lubrication and wear) whereas a suitable profile of residual compressive stress improves the fatigue strength.

The invention is further illustrated in the following examples together with the drawing. It should, however, be understood that the specific examples are merely included to illustrate the preferred embodiments and that various alterations and modifications within the scope of protection will be obvious to persons skilled in the art on the basis of the detailed description.

EXAMPLES

Example 1

Nitrocarburising in Pure Urea Gas and Inert Argon Carrier Gas: Austenitic Stainless Steel AISI 316

An article of austenitic stainless steel AISI 316 was nitrocarburised in a tube furnace by leading argon gas over, initially solid, urea while heating from room temperature to 440° C. within 45 minutes. The initially solid urea was positioned at the inlet of the tube furnace. Upon reaching 440° C. the article was cooled to room temperature in argon gas (Ar) within 10 minutes. The total thickness of the hardened zone is about 10 μm.

Figure 1:
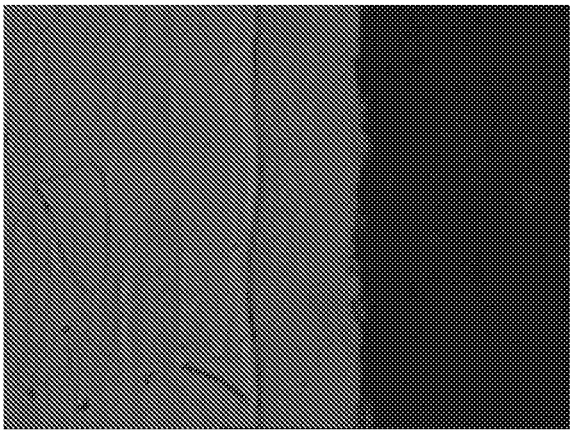
FIG. 1 is a cross sectional micrograph of an article of austenitic stainless steel which has been activated followed by nitrocarburising with urea in argon as described in example 1.

FIG. 1 is a cross sectional micrograph showing a 10 μm thick expanded austenite layer. The outermost part of the expanded austenite layer is nitrogen expanded austenite, and the innermost layer is carbon expanded austenite. This result is highly surprising because it is unparalleled by the known prior knowledge on nitriding/nitrocarburising (or carburising) of austenitic stainless steel with respect to the development of a well defined expanded austenite layer of this large thickness at this temperature in such a short time span, regardless of whether the treatment is carried out by a gaseous or a plasma-assisted treatment.

Example 2

Nitrocarburising in Urea Gas and Hydrogen Gas: Austenitic Stainless Steel AISI 316

An article of austenitic stainless steel AISI 316 was nitrocarburised in a tube furnace by leading hydrogen gas over initially solid urea while heating from room temperature to 490° C. within 45 minutes. The initially solid urea was positioned at the inlet of the tube furnace. Upon reaching 490° C. the article was cooled to room temperature in argon gas (Ar) within 10 minutes. The total thickness of the hardened zone is about 22 μm. The micro-hardness of the surface was more than 1500 HV (as measured with a load of 25 g). The untreated stainless steel had a hardness between 200 and 300 HV.

Figure 2A:
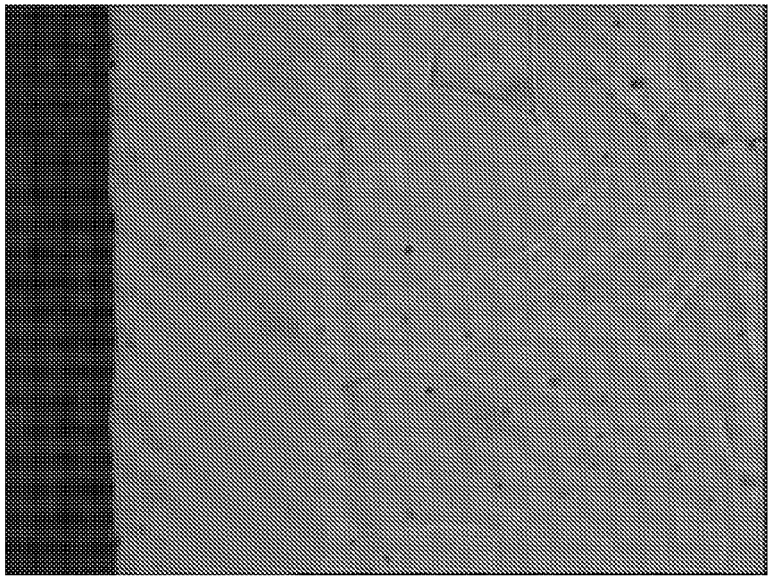
FIG. 2*a* is a cross sectional micrograph of an article of austenitic stainless steel which has been activated followed by nitrocarburising with urea in hydrogen as described in example 2.
Figure 2B:
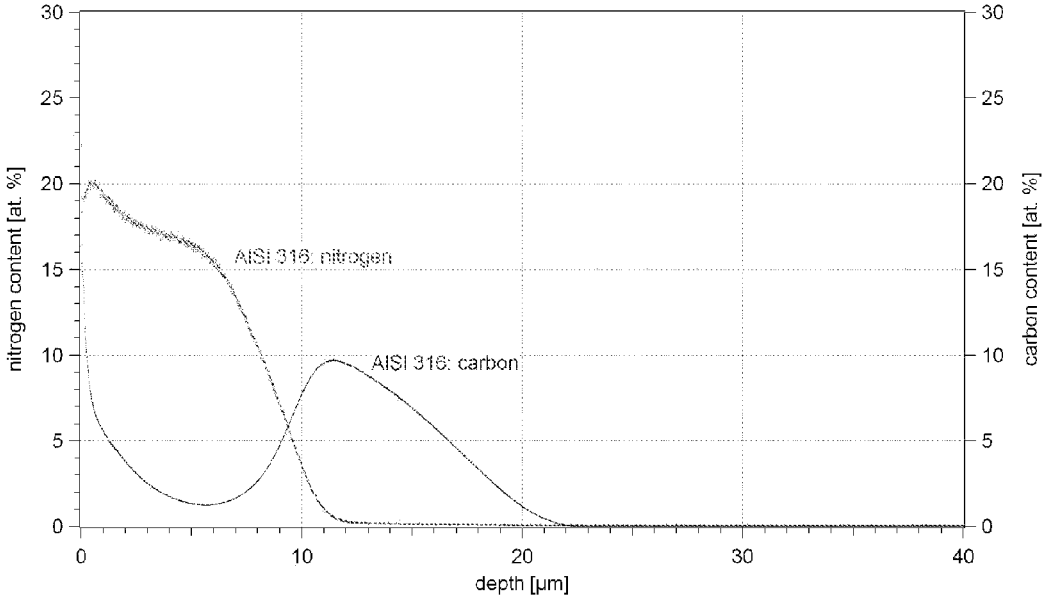
FIG. 2*b* is a Glow Discharge Optical Emission Spectroscopy (GDOES) depth profile of the same article as in FIG. 2*a*.

FIGS. 2*a* and 2*b* are cross sectional micrograph and Glow Discharge Optical Emission Spectroscopy (GDOES) depth profile, respectively and show that the outermost layer was nitrogen expanded austenite, and the innermost layer was carbon expanded austenite.

This example demonstrates very surprising results on the background of the known prior knowledge on nitriding/nitrocarburising (and carburising) of austenitic stainless steel with respect to the development of a well defined expanded austenite layer of this thickness neither at this temperature nor in such a short time span, regardless of whether the treatment is carried out by a gaseous or a plasma-assisted treatment. Thicknesses of this magnitude are usually achieved at temperatures well below 450° C. for treatment times over 20 hours Example 3

Nitriding in Urea Gas and Hydrogen Gas: Martensitic Stainless Steel AISI 420

An article of martensitic stainless steel AISI 420 was nitrocarburised in a tube furnace by leading hydrogen gas over initially solid urea while heating from room temperature to 470° C. within 45 minutes. The initially solid urea was positioned at the inlet of the tube furnace. Upon reaching 470° C. the article was cooled to room temperature in argon gas (Ar) within 10 minutes. The thickness of the hardened zone is about 30 μm. The layer was nitrogen expanded martensite as determined by X-ray diffraction. The micro-hardness of the surface was more than 1800 HV (as measured with a load of 5 g). The untreated stainless steel had a hardness between 400 and 500 HV.

Figure 3:
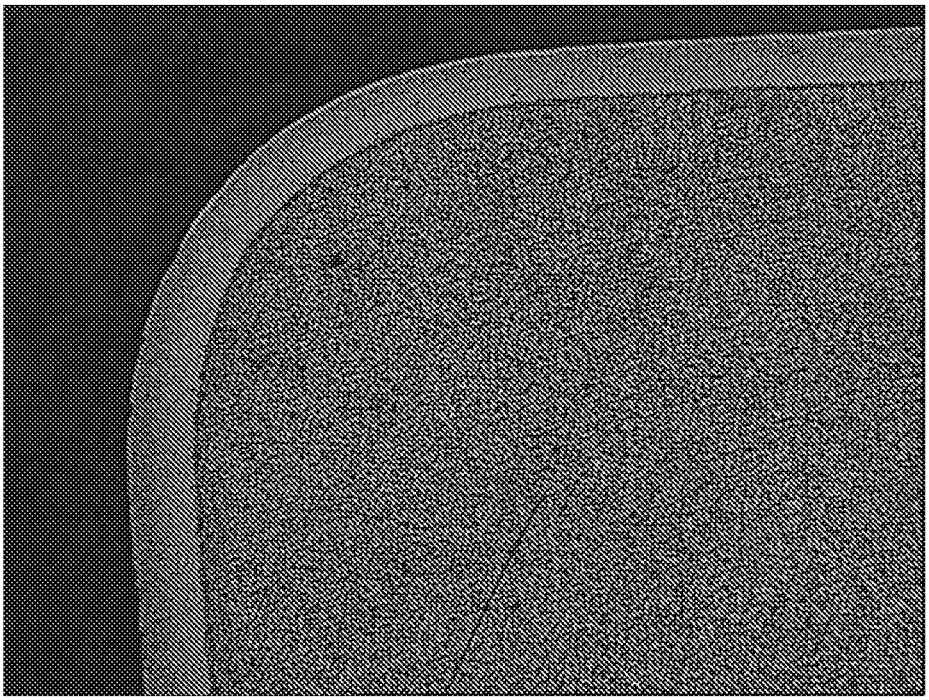
FIG. 3 is a cross sectional micrograph of an article of martensitic stainless steel which has been activated followed by nitrocarburising with urea in hydrogen as described in example 3.

FIG. 3 is a cross sectional micrograph of an article and shows the hardened zone of expanded martensite.

Also this example demonstrates highly surprising results considering the known prior knowledge on nitriding/nitrocarburising (and carburising) of stainless steel with respect to the development of a well defined layer of this large thickness on martensitic stainless steel at this temperature in such a short time span, regardless of whether the treatment is carried out by a gaseous or a plasma-assisted treatment.

Example 4

Nitriding in Urea Gas and Hydrogen Gas, Martensitic Stainless Steel: AISI 431

An article of martensitic stainless steel AISI 431 was nitrocarburised in a tube furnace by leading hydrogen gas over urea while heating from room temperature to 470° C. within 45 minutes. The initially solid urea was positioned at the inlet of the tube furnace. Upon reaching 470° C. the article was cooled to room temperature in argon gas (Ar) within 10 minutes. The thickness of the hardened zone is about 25 μm.

Figure 4A:
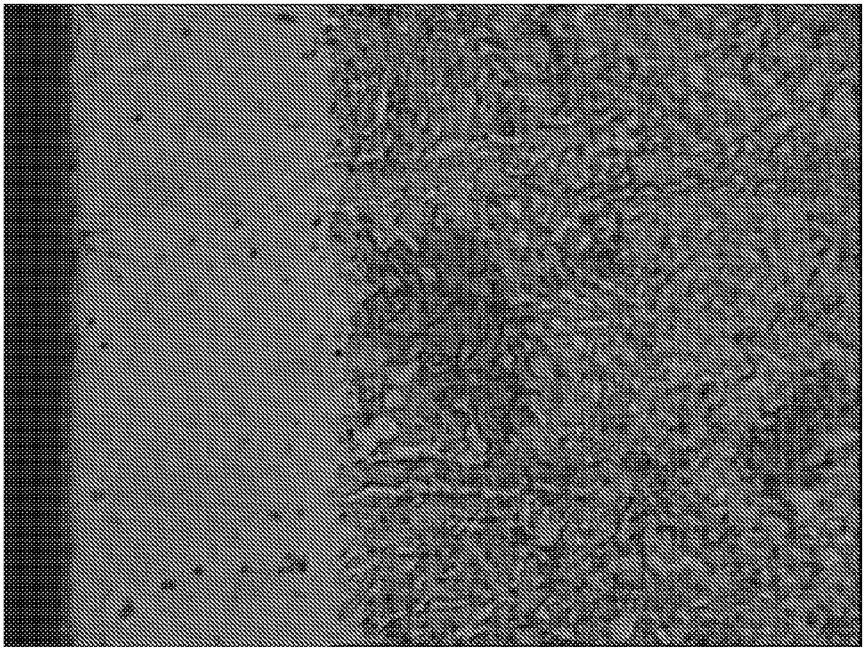
FIG. 4*a* is a cross sectional micrograph of an article of martensitic stainless steel which has been activated followed by nitrocarburising with urea in hydrogen as described in example 4.
Figure 4B:
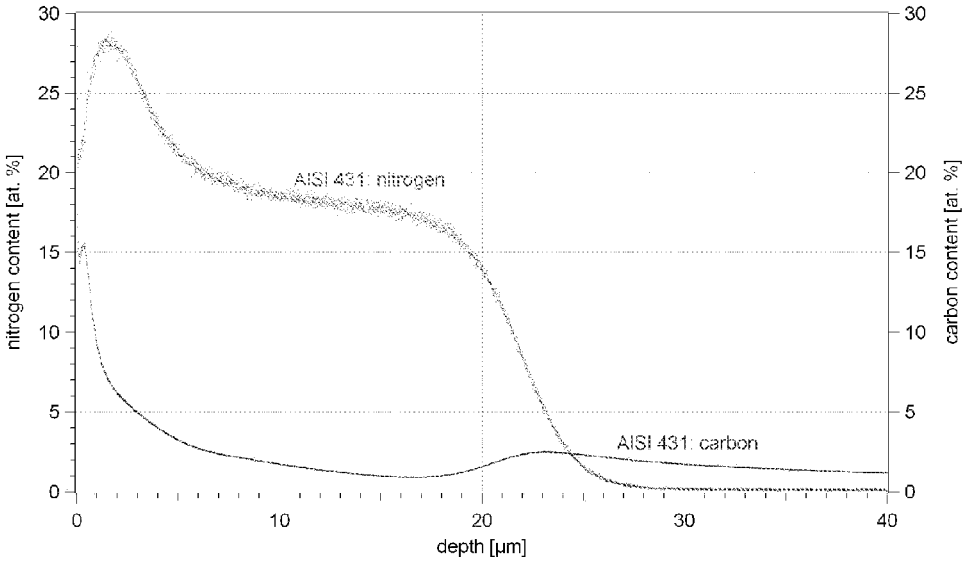
FIG. 4*b* is a Glow Discharge Optical Emission Spectroscopy (GDOES) depth profile of the same article as in FIG. 4*a*.

FIGS. 4*a* and 4*b* are cross sectional micrograph and GD OES depth profile, respectively, and show that the layer was mainly nitrogen expanded martensite and hardly any carbon expanded martensite. This result is highly surprising because it is unparalleled the known prior knowledge on nitriding/nitrocarburising (and carburising) of stainless steel with respect to the development of a well defined layer of this large thickness on martensitic stainless steel at this temperature in such a short time span, regardless of whether the treatment is carried out by a gaseous or a plasma-assisted treatment.

Example 5

Nitrocarburising in Urea Gas and Hydrogen Gas: Precipitation Hardening (PH) Stainless Steel An article of precipitation hardening stainless steel (Uddeholm Corrax®) was nitrocarburised in a tube furnace by leading hydrogen gas over urea while heating from room temperature to 460° C. within 45 minutes. The initially solid urea was positioned at the inlet of the tube furnace. Upon reaching 460° C. the article was cooled to room temperature in argon gas (Ar) within 10 minutes. The total thickness of the hardened zone is about 20 μm.

Figure 5:
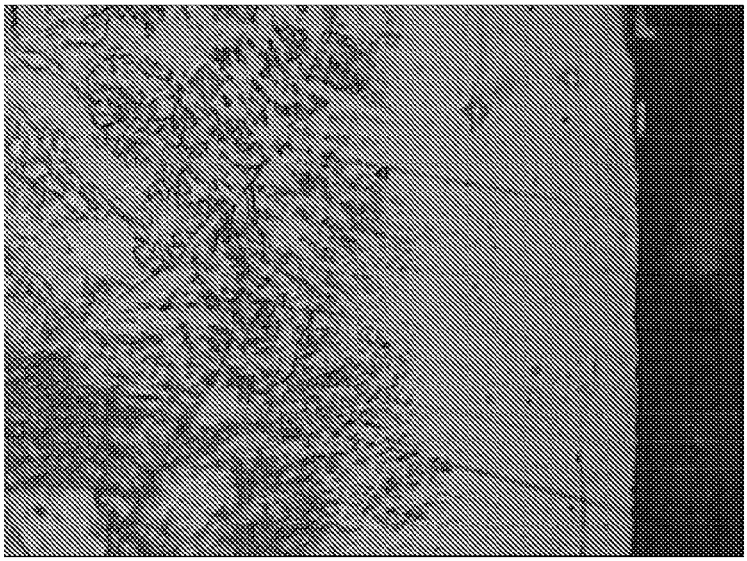
FIG. 5 is a cross sectional micrograph of an article of PH stainless steel which has been activated followed by nitrocarburising with urea in hydrogen as described in example 5.

FIG. 5 is a cross sectional micrograph and shows the hardened zone of expanded martensite/austenite as well as a few hardness indentations, which indicate the appreciable increase of hardness (the smaller the indent the higher is the hardness). This result is highly surprising because it is unparalleled the known prior knowledge on nitriding/nitrocarburising (and carburising) of stainless steel with respect to the development of a well defined layer of this large thickness on precipitation hardening stainless steel at this temperature in such a short time span, regardless of whether the treatment is carried out by a gaseous or a plasma-assisted treatment.

Example 6

Nitrocarburising in Urea Gas and Hydrogen Gas: Titanium

An article of titanium (a non-ferrous self-passivating material) was nitrocarburised in a tube furnace by leading hydrogen gas over initially solid urea while heating from room temperature continuously to 580° C. within 45 minutes. The initially solid urea was positioned at the inlet of the tube furnace. Upon reaching 580° C. the article was cooled to room temperature in argon gas (Ar) within 10 minutes. The micro-hardness of the surface is higher than 1100 HV (load 5 g), whilst the untreated titanium has a hardness between 200 and 300 HV. This example demonstrates the possibility of nitrocarburising a typical self-passivating metal when the material is first activated at a temperature below 500° C. Assuming that the depassivation takes place already below 250° C. whereas the nitrocarburising starts at 450-470° C. the treatment in Example 6 clearly included an active period of de-passivation as demonstrated by the very short but efficient nitrocarburising treatment obtained.

Figure 6:
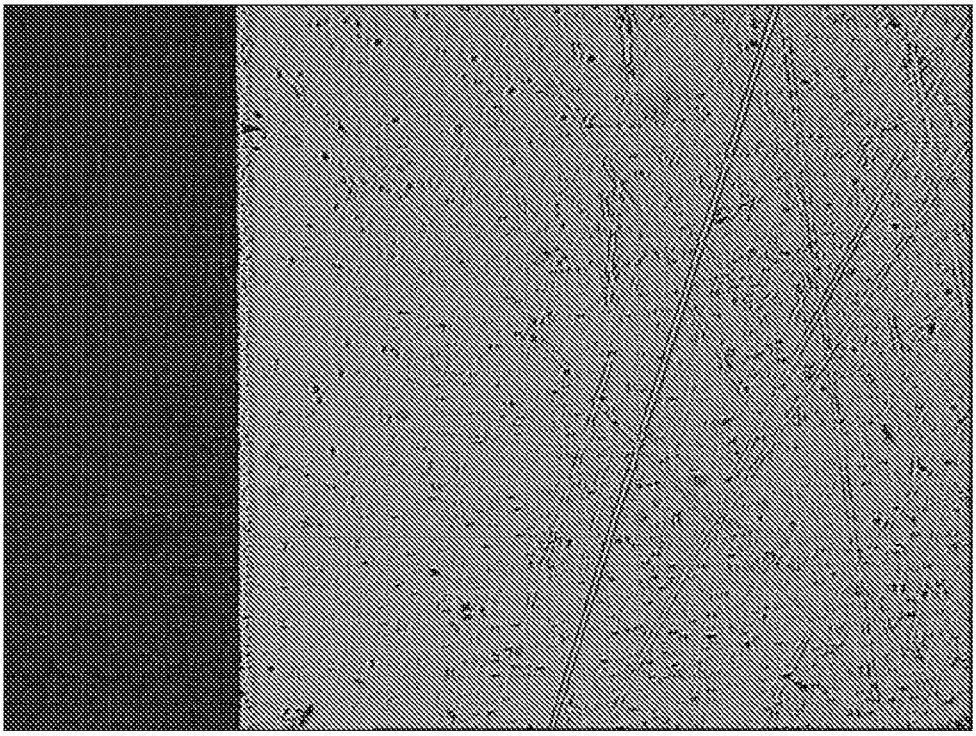
FIG. 6 is a cross sectional micrograph of an article of titanium which has been activated followed by nitrocarburising with urea in hydrogen as described in example 6.

FIG. 6 is a cross sectional micrograph and shows the affected surface region characterised by solid solution of nitrogen/carbon in Ti.

Example 7

Activation with Pure Urea and Inert Argon Carrier Gas, and Subsequent Nitrocarburising with Pure Urea and Inert Argon Carrier Gas, Austenitic Stainless Steel AISI 316

A tube furnace with two separate heating zones was applied, i.e. the two zones could be maintained at two different temperatures. Inert Argon gas was introduced in the furnace by a controllable gas flow meter. The initially solid urea was placed in the first heating zone in the furnace inlet and the AISI 316 articles were placed in the second heating zone. The tube furnace was flushed with pure argon gas and the solid urea was heated to 150° C., where it is a liquid, and simultaneously the articles to be treated were heated to 300° C. The heating rate applied was 20 K/min. Throughout the experiment, the urea liquid solution was kept at 150° C.; the gas decomposition products in this temperature regime are believed to comprise HNCO. The gas decomposition products from the liquid urea were transferred by the inert Ar carrier gas to the articles to be treated (downstream). The articles were kept at 300° C. for 5 hours for activating the surface. After the activation period the articles were heated to a nitrocarburising temperature of 400° C. The articles were kept at the nitrocarburising temperature for 12 hours and were nitrocarburised in the degassing products from the liquid urea. Cooling to room temperature was carried out in argon gas (Ar) in less than 10 minutes. The articles was analysed by optical microscopy. The total layer thickness was 15 μm. The outermost layer was nitrogen-expanded austenite, and the innermost layer was carbon-expanded austenite.

Figure 7:
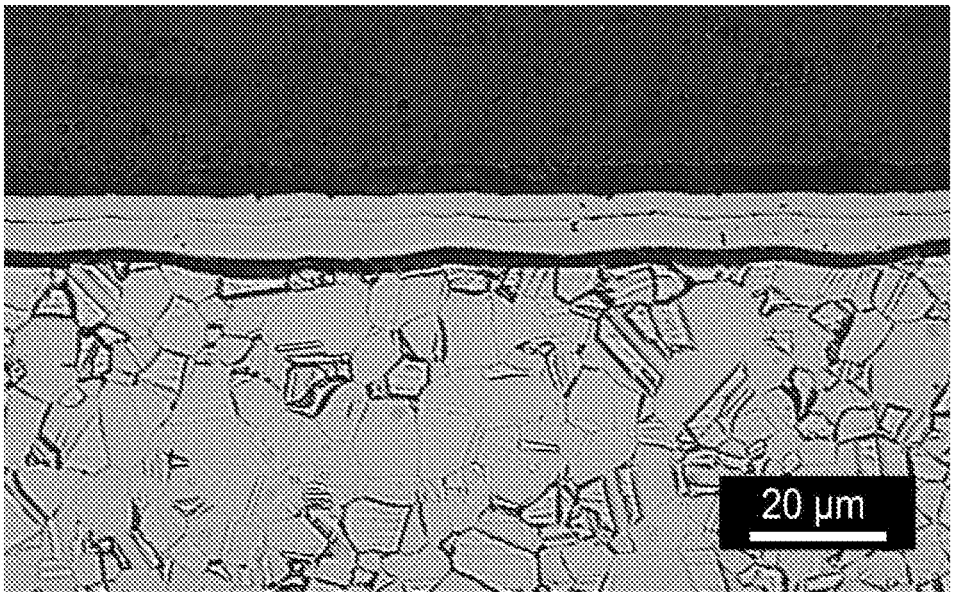
FIG. 7 is a cross sectional micrograph of an article of AISI 316 austenitic stainless steel which has been activated followed by nitrocarburising with urea as described in example 7.

FIG. 7 is a cross sectional micrograph of the resulting article of AISI 316 austenitic stainless steel which has been activated followed by nitrocarburising with urea as described above.

Example 8

Activation and Subsequent Nitrocarburising with Formamide and Inert Nitrogen Carrier Gas, Austenitic Stainless Steel AISI 316

Gaseous nitro-carburising was performed in a tube furnace equipped with gas flow meters for accurate control of the gas flow and a liquid flow meter for accurate control of formamide flow. The tube furnace was flushed with pure nitrogen ($N_2$) gas and the AISI 316 articles to be treated were heated to a temperature of 460° C. with a heating rate of 20 K/min. After reaching the nitriding temperature, liquid formamide was introduced by a probe directly into the hot zone of the tube furnace where it instantaneously vapourised. The articles were kept at the nitrocarburising temperature for 16 hours and were nitrocarburised in pure formamide gas/decomposition products thereof and inert nitrogen gas. Cooling to room temperature was carried out in nitrogen gas in less than 10 minutes. The article was analysed by optical microscopy. The total layer thickness was 35 μm. The outermost layer was nitrogen-expanded austenite, and the innermost layer was carbon-expanded austenite.

Figure 8:
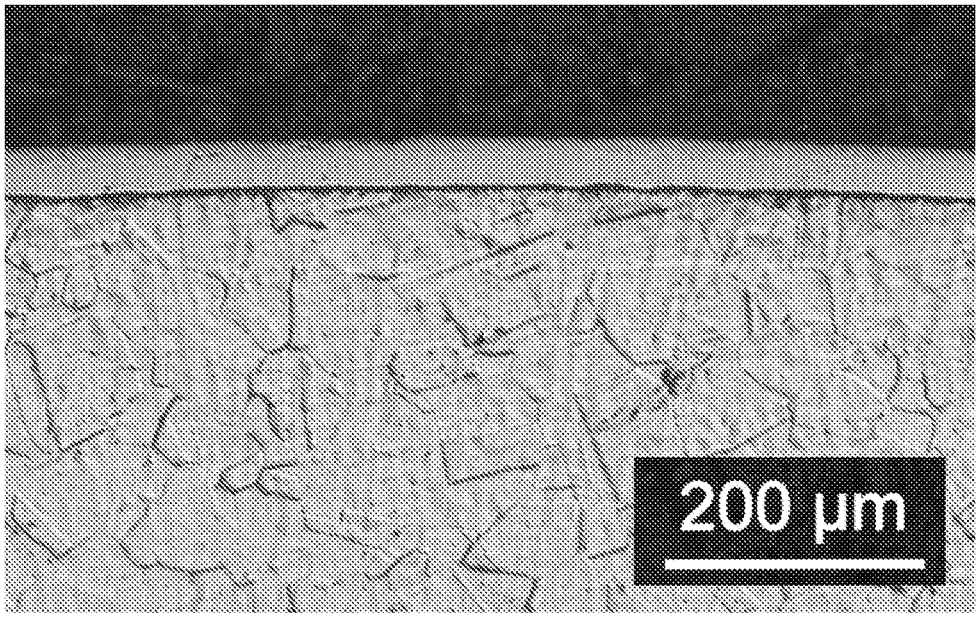
FIG. 8 is a cross sectional micrograph of an article of AISI 316 austenitic stainless steel which has been activated followed by nitrocarburising with formamide as described in example 8.

FIG. 8 is a cross sectional micrograph of the resulting article of AISI 316 austenitic stainless steel which has been activated followed by nitrocarburising with formamide as described above.

The above description of the invention shows that it can be varied in many ways. Such variations are not to be considered a deviation from the scope of the invention, and all such modifications which are obvious to persons skilled in the art are also to be considered comprised by the scope of the succeeding claims.

The invention claimed is:

1. A method of case hardening an article of stainless steel, a nickel alloy, a cobalt alloy, a titanium based material or combinations thereof, the method comprising;

providing a heating apparatus having a first heating zone downstream of a second heating zone, the heating apparatus having a gas inlet and a gas outlet for providing a passage of gas through the heating apparatus, heating the article in the first zone of the heating apparatus to a first temperature in a range of 185 to 500° C., heating in the second heating zone of the heating apparatus at least one compound containing nitrogen and carbon, said compound having a single, double, or triple carbon-nitrogen bond, which compound is liquid or solid at a temperature of 25° C. and a pressure of 1 bar, said compound hereinafter called an N/C compound, to a second temperature which is lower than the first temperature, and which is in a range of 135 to 450° C. for providing one or more gaseous species, and establishing a passage of gas using a carrier gas that is non-oxidative to the article for contacting the article with the gaseous species to activate the article, and successively heating the article in the heating apparatus in the presence of the gaseous species to a carburizing, nitriding, or nitrocarburizing temperature which is at least as high as the first temperature and which is below 500° C.

2. The method according to claim 1, wherein a difference between the first temperature and the second temperature is at least 50° C.

3. The method according to claim 1, wherein the N/C compound is an amide.

4. The method according to claim 1, wherein the N/C compound is selected from the group consisting of urea, acetamide, and formamide.

5. The method according to claim 1, wherein the N/C compound is urea.

6. The method according to claim 1, wherein the first temperature is in a range of 250 to 350° C.

7. The method according to claim 1, wherein the second temperature is below 250° C.

8. The method according to claim 1, wherein the second temperature is in a range of 135 to 170° C.

9. The method according to claim 1, wherein the article is contacted with the gaseous species for at least one hour.

10. The method according to claim 1, wherein the same N/C compound is used both for activation and for subsequent carburizing, nitriding or nitrocarburizing.

11. A method of case hardening an article of stainless steel, a nickel alloy, a cobalt alloy, a titanium based material or combinations thereof, the method comprising:

providing a heating apparatus having a doser;

heating the article in the heating apparatus to a first temperature in the range of 185 to 500° C.;

introducing at least one compound containing nitrogen and carbon, said compound having a single, double, or triple carbon-nitrogen bond, which compound is liquid or solid at a temperature of 25° C. and a pressure of 1 bar, said compound hereinafter called an N/C compound, into the heating apparatus by the doser;

allowing the N/C compound to vaporize to form a gaseous species and allowing the gaseous species to contact the article to activate the article;

successively heating the article in the heating apparatus in the presence of the gaseous species to a carburizing, nitridinq, or nitrocarburizinq temperature which is at least as high as the first temperature and which is below 500° C.

12. The method according to claim 11, wherein the N/C compound is introduced into the heating apparatus by a carrier gas that is non-oxidative to the article.

13. The method according to claim 12 wherein the N/C compound is introduced continuously or discontinuously into the heating apparatus.

14. The method according to claim 11, wherein the N/C compound is liquid.

15. The method according to claim 11, wherein the first temperature is in a range of 350 to 500° C.

16. The method according to claim 11, wherein the N/C compound is an amide.

17. The method according to claim 11, wherein the N/C compound is selected from the group consisting of urea, acetamide, and foramide.

18. The method according to claim 11, wherein the N/C compound is urea.

19. The method according to claim 11, wherein the article is contacted with the gaseous species for at least one hour.

20. The method according to claim 11, wherein the same N/C compound is used both for activation and for subsequent carburizing, nitriding or nitrocarburizing.

* * * * *

UNITED STATES PATENT AND TRADEMARK OFFICE

CERTIFICATE OF CORRECTION

PATENT NO. : 8,845,823 B2
APPLICATION NO. : 13/384689
DATED : September 30, 2014
INVENTOR(S) : Christiansen et al.

It is certified that error appears in the above-identified patent and that said Letters Patent is hereby corrected as shown below:

In the Claims,

Claim 11, Column 15, line 9: Remove "nitridinq and nitrocarburizinq" and replace with "nitriding and nitrocarburizing"

Signed and Sealed this
Thirteenth Day of January, 2015

Michelle K. Lee

Michelle K. Lee
*Deputy Director of the United States Patent and Trademark Office*